United States Patent [19]

Kobayashi et al.

[11] Patent Number: 4,799,502

[45] Date of Patent: Jan. 24, 1989

[54] WIG

[75] Inventors: Hisao Kobayashi; Kousuke Mochizuki, both of Tokyo, Japan

[73] Assignee: Aderans Co., Ltd., Tokyo, Japan

[21] Appl. No.: 942,772

[22] Filed: Dec. 17, 1986

[30] Foreign Application Priority Data

Dec. 24, 1985 [JP] Japan ..... 60-197535[U]
Feb. 17, 1986 [JP] Japan ..... 61-21873[U]

[51] Int. Cl.[4] ..... A41G 3/00
[52] U.S. Cl. ..... 132/53
[58] Field of Search ..... 132/5, 7, 53, 54, 56

[56] References Cited

U.S. PATENT DOCUMENTS

| | | | |
|---|---|---|---|
| 1,144,658 | 6/1915 | Lombard | 132/5 |
| 1,740,764 | 12/1929 | Borg | 132/5 |
| 2,233,100 | 2/1941 | Jevnikar | 132/53 |
| 2,438,005 | 4/1946 | Goldman | 132/53 |
| 2,736,325 | 2/1956 | Dvorzsak | 132/53 |
| 3,905,378 | 9/1975 | Levin et al. | 132/5 |
| 4,517,999 | 5/1985 | Finamore | 132/5 |

FOREIGN PATENT DOCUMENTS

| | | | |
|---|---|---|---|
| 0207160 | 1/1987 | European Pat. Off. . | |
| 1917993 | 2/1970 | Fed. Rep. of Germany . | |
| 1814369 | 8/1970 | Fed. Rep. of Germany . | |
| 3147143 | 6/1983 | Fed. Rep. of Germany | 132/53 |
| 2540357 | 8/1984 | Fed. Rep. of Germany . | |
| 2210363 | 7/1974 | France . | |
| WO86/02811 | 5/1986 | PCT Int'l Appl. . | |
| 1255440 | 12/1971 | United Kingdom . | |

*Primary Examiner*—Gene Mancene
*Assistant Examiner*—R. Thomas Price
*Attorney, Agent, or Firm*—Nixon & Vanderhye

[57] ABSTRACT

A wig or hairpiece comprising a wig base formed by a network having a convexly curved surface corresponding to the counter of a user's head, and hairs planted over the entire convexly curved surface of the network. The wig base is formed in a zigzag fashion at its front edge portion which corresponds to a hairline at the user's forehead. The wig base is stitched at a location slightly inside its front edge portion by a filament.

19 Claims, 4 Drawing Sheets

WIG

FIELD OF THE INVENTION

The present invention relates to a wig or hairpiece whose base is formed by a network and, more particularly, to an improvement in wigs or hairpieces whereby a natural hairline is simulated at a wearer's forehead. Hair whirls may also be formed on the wig. Furthermore, the wig base of this invention, which is exposed at the hair-parting line, appears as if it was the natural scalp of the wearer, while yet providing a wig of sufficient durability.

BACKGROUND AND SUMMARY OF THE INVENTION

Various kinds of wigs or hairpieces whose bases are formed by networks are well known. One of these wig bases is known, for example, from the wig base manufacturing method disclosed in Japanese Patent Preliminary Publication No. Sho 61-124615 laid open to public inspection on June 12, 1986 and filed by the same applicant as that of the present application. According to this wig base manufacturing method, the wig base is formed by applying a special shaping treatment to its network to insure that the wig can keep its contour and dimension in strict agreement with the shape of the head of the wearer or user on which the wig is to be placed. This makes it more difficult for the wig base to be deformed, even after it is used for a long time. However, no attempt is made to make the front edge portion of the wig base (which is located at the hairline on the user's forehead) look natural.

In the case of a wig whose base is formed by a network, a fringing ribbon or tape is stitched or stuck along the inner surface of the peripheral edge of the network so as to reinforce the same and to conform the entire wig to the contour of the user's head which is to be covered by the wig. In wigs of the so-called "hard front" type, this fringing ribbon or tape is stitched to the inner surface of the front edge portion of the wig base which corresponds to the hairline portion on the user's forehead, so that the front edge portion of the wig is prevented from floating from the user's forehead.

If this reinforcement technique of stitching or sticking the fringing ribbon or tape to the wig base is applied to the wig base which is made according to the method disclosed in Japanese Patent Preliminary Publication No. Sho 61-124615, the wig thus formed keeps its shape more effectively and is more durable. However, in those wigs adapted for brush-back hair styles, those hairs which have been attached to the outer surface of the front edge portion of the wig base are combed rearwardly from the hairline at the front edge portion of the wig base. Therefore, the fringing ribbon or tape which has been stitched or stuck to the inner surface of the front edge portion of the wig base is exposed thereby creating a visual indication of the presence of the wig.

In order to overcome this problem, a wig or hairpiece of the so-called "lace front" type is disclosed in U.S. Pat. No. 4,509,539, for example. In the case of this wig, the entire wig base is constituted by a network of lace meshes wherein a plurality of filaments cross one another and are ultrasonically welded at their intersections so as to form a mesh. Therefore, this network of lace meshes is not fringed at the front edge portion thereof and the wig of this type thus exhibits a hairline whereby the hairs appear to be growing directly from the user's scalp at his forehead area. Even in the case of brush-back hair styles, therefore, the border between the user's forehead and the front edge portion of the wig can certainly provide a natural hairline, but this wig or hairpiece has other drawbacks. For example, the network of those filaments which form the front edge portion of the wig base is ultrasonically welded at the intersections of the filaments, but is not fringed at its front edge portion. Accordingly, the shape-retainability of the network is low as compared with the above-described hard front type. Secular change or distortion causes the wig to lose its shape and become deformed. Clearances are thus created between the user's forehead and the front edge portion of the wig base, thereby causing the front edge portion to be curled up or bent under itself and sometimes causing the filaments, which form the front edge portion of the wig base, to become visible due to the front edge portion of the wig base floating from the user's forehead. When this wig is used for a long period of time, those filaments which form the wig base along the front edge portion thereof are parted from one another at some of their welded intersections and some of those filaments which form the unreinforced network are broken, thereby making it more likely that the network will become loose at the front edge portion of the wig base. The deformation of the wig base and the loosening of the network at the front edge portion thereof are often caused when the hair is brushed, washed and carelessly treated, thereby reducing the wig's durability. On the other hand, wigs of the lace mesh type are comprised of a network as a whole. In the case where a hair-parting line is formed on the wig, therefore, the filaments which form the network are exposed at this hair parting line where the user's own skin should appear, thereby visually indicating the presence of the wig.

If a hair whirl is to be formed on the wig, hair fibers which are planted on the surface of the wig base must have a higher density at an area where the hair whirl is formed, than at the remaining area. When they are planted, the hair fibers must also be directed in clockwise or counterclockwise direction in a spirally extending manner. In a case where the hair whirl is to be formed on the wig which is made by a network according to U.S. Pat. No. 4,509,539, however, the planted hair fibers cannot be increased in number because the network is formed in a rectangular mesh having constant intervals. Further, since the hair fibers are tied to those filaments which form the rectangular mesh, they have a lattice pattern when thus planted, thereby making it difficult to form a spiral pattern. Still further, each of the hair fibers which have been tied to the filaments is shifted from its original position and direction by hair brushing or the like. It is therefore difficult with the wig disclosed in U.S. Pat. No. 4,509,539 to maintain the planted hair fibers in a uniform direction, thereby making it impossible to form hair whirls.

Furthermore, in order to make the hairline look natural at the front edge portion of the wig base, it is more preferable that the hair fibers to be planted at the front edge portion are tied thereto at appropriate intervals and at random rather than in linear and close alignment. If meshes are rough at the front edge portion of the wig base, however, the tied hair fibers are limited in number and position, thereby making it difficult to provide a random and natural hairline.

SUMMARY OF THE INVENTION

An object of the invention is to provide a wig or hairpiece which can retain the advantages of the above-described wigs of the hard and lace front types, but which eliminates the disadvantages.

Another object of the invention is to provide a wig or hairpiece wherein the wig base cannot become loose at its front edge portion which corresponds to the hairline at a user's forehead and wherein those hair fibers which have been planted at the front edge portion of the wig base creates a natural hairline.

A further object of the invention is to provide a wig or hairpiece enabling a hair whirl to be formed on the wig base and enabling hairs to appear as if they were growing directly from the user's own scalp, so that a network which forms the wig base is not visible at the hair whirl and hair-parting line.

A still further object of the invention is to provide a wig or hairpiece which can keep its shape even after its long use and which is light weight and has sufficient ventilation.

According to the invention, these and other objects can be achieved by a wig or hairpiece comprising a wig base constituted by a network having a convexly curved surface which conforms in contour to a user's head, and hair fibers planted entirely over the convexly curved surface o the wig base. The network of the wig base is formed in a zigzag fashion at its front edge portion (which corresponds to the hairline at the user's forehead) and the front edge portion of the wig base is stitched at a location slightly inside the front edge thereof by a filament.

Preferably, the wig or hairpiece is cut out at least at an area of its network where a hair whirl is to be formed, and this cut-out is covered by a flesh-colored artificial skin made of a sheet of flexible plastic and having a shape similar to the cut-out. In this case, the artificial skin complementarily attached to the cut-out is formed in a zigzag fashion at the front edge portion thereof, like the front edge portion of the network. The front edge portion of the cut-out is likewise formed in a zigzag fashion. The artificial skin is preferably provided with a plurality of apertures for ventilation.

The network which forms the wig base is stitched in a zigzag fashion at a location slightly behind the front edge thereof by a filament. The zigzag stitching of the filament extends in phase with or in opposite phase with the zigzag front edge portion of the network.

The wig or hairpiece comprises a first net occupying hair-parting and forehead areas of the network and a second net occupying the remaining area of the network. The first net has a smaller mesh size than that of the second net. For example, the first net has about 28–48 meshes per square inch, while the second net has about 14–24 meshes per square inch, preferably about 16–20 meshes per square inch. The first and second nets are bonded to each other by resin coating or stitching at their respective peripheral edges.

According to the invention, almost all of the wig base is formed by a network and excellent ventilation is thus provided to prevent the user's head from becoming stuffy. Further, the zigzag front edge of the wig base makes it difficult for a third person to visually notice the front edge portion of the wig base. Still further, the wig base is stitched at a location slightly inside the front edge thereof by a filament and thus reinforced, so that the net can be prevented from becoming loose at the front edge portion of the wig base even after the wig is used for a long period, and that the wig base can also be prevented from curling up or from being deformed in its shape at the front edge portion thereof during use.

According to one aspect of the invention, if an area of the wig base where a hair whirl is to be formed, and/or a hair-parting area of the wig base are formed by a flesh-colored artificial skin instead of a network, the hair whirl can be formed by implanted hair fibers. In this case, the artificial skin which is exposed at the hair whirl and along the hair-parting portion makes it more difficult for a third person to visually notice the presence of the wig.

Further, according to another aspect of the invention, the hair-parting portion of the wig base including that area thereof which corresponds to the user's forehead is formed by a first net which has smaller mesh than that of a second net which occupies the remaining area of the wig base network. The first, smaller mesh net is thus exposed at the front edge portion and along the hair-parting portion of the wig base, thereby leaving the presence of the wig much less noticeable. In addition, the first net can help the wig base keep its shape. In this case, the hair fibers can be randomly attached to the first, smaller mesh net at the front edge portion of the wig base, thereby creating a natural hairline.

Other objects, features and advantages of the invention will become apparent from the following detailed description with reference to the accompanying drawings.

DETAILED DESCRIPTION OF THE PREFERRED EMBODIMENTS

Figure 1:
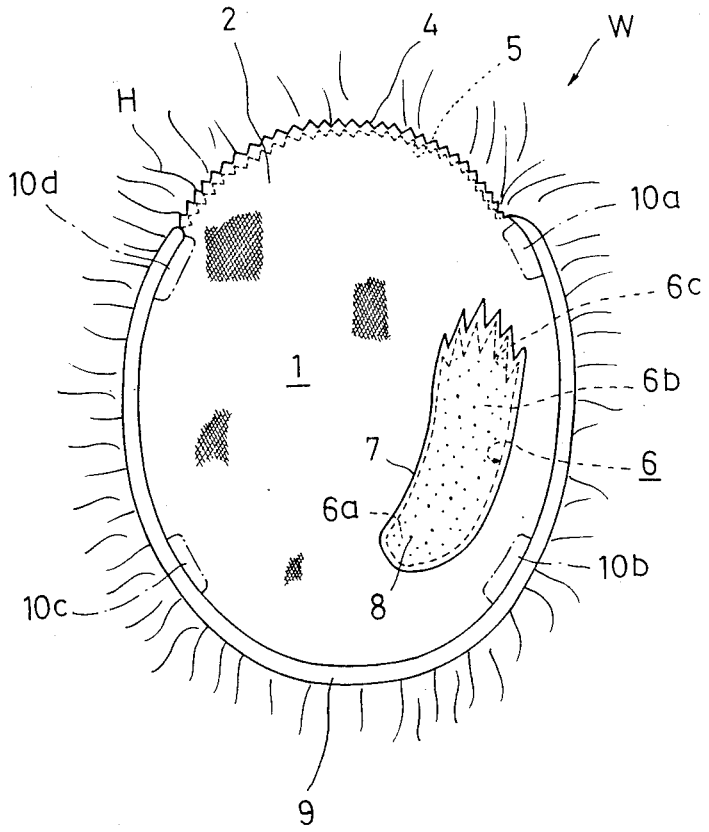
FIG. 1 is a bottom view showing the inner surface of a wig or hairpiece according to a first embodiment of the invention.

The invention will be described in detail, referring to some embodiments of the present invention shown in the drawings.

FIG. 1 is a view showing the inner surface of a wig or hairpiece W according to a first embodiment of the invention. The wig W comprises a wig base 1 having a convexly curved surface in strict agreement in contour and dimension with the configuration of a user's head, and human and/or artificial hairs H attached to the convexly curved surface of the wig base 1.

Figure 2:
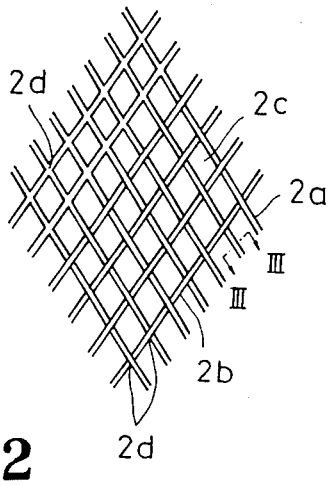
FIG. 2 is a fragmental enlarged view showing a net which forms the base of the wig shown in FIG. 1.
Figure 3:
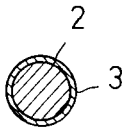
FIG. 3 is a cross-sectional view taken along a line III—III in FIG. 2.
Figure 4:
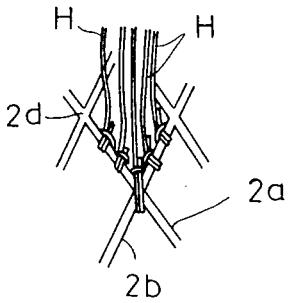
FIG. 4 is a fragmental enlarged view showing hair fibers attached to filaments which form the net.

Substantially the entire wig base 1 is formed by a network 2 comprising first and second filaments 2a and 2b (see, FIG. 2). Each filament is colored to resemble the color of user's scalp. Each filament is preferably formed of 220–330 denier nylon. The first and second filaments 2a and 2b are plain-woven in which they alternately cross each other in spaced relation. The first and second filaments 2a and 2b thus woven are ultrasonically welded at their intersections 2d to form rectangular or preferably rhomboid net patterns 2c, as shown in FIG. 2. Each o the filaments 2a and 2b, which form the network 2, is coated with a polyurethane resin film 3, as shown in FIG. 3, to enable each filament to have sufficient strength and to enable the wig base 1 to retain its convexly curved configuration which is in agreement with the user's head. (The method of forming this network 2 is disclosed in Japanese Patent Preliminary Publication No. Sho 61-124615 filed by the same applicant as that of the present application). As shown in FIG. 4, hair fibers H are tied to the first and second filaments 2a and 2b at appropriate locations thereon, and to the welded-intersections 2d of these filaments.

Figure 5:
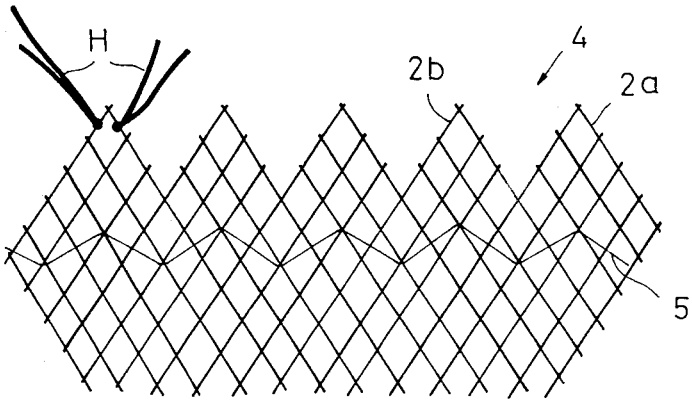
FIG. 5 is a fragmental enlarged, diagrammatic view showing the front edge portion of the wig base.

The network 2, which forms the wig base 1, has a front edge portion 4 which corresponds to the position and dimension of the hairline at the user's forehead. As is clearly seen from FIG. 5 showing, in an exaggerated manner, the front end portion 4 of the network 2, the edge of the front edge portion 4 is formed in a zigzag fashion and extends between the opposite ends of the hairline at the user's forehead, in order to achieve camouflaging effects, that is, in order that the front edge portion 4 of the wig base 1 exhibits a natural hairline so that the border line between the front edge portion 4 and the hairline at the user's forehead is indistinguishable in appearance. The hair fibers H are tied up to locations as near the tips of the zigzag front edge portion 4 as possible. Further, the wig base 1 is stitched about 3–15 mm inside the zigzag front edge portion 4 by a nylon filament 5 made of the same material and colored in the same color as the first and second filaments 2a and 2b. The nylon filament 5 extends in a zigzag fashion in phase with or in opposite phase with the zigzags front edge portion 4 and extends between the opposite corners of the hairline at the user's forehead. If the stitching filament 5 is not zigzag-but line-sewed, the filament 5 would easily be noticed through clearances between the planted hair fibers H. It is therefore preferable that the fringing is effected by stitching filament 5 in a zigzag fashion. It is also preferable that the nylon filament which is used as the stitching filament 5 is as fine as possible, e.g., having 30–60 deniers, more preferably 40–50 deniers. If the stitching filament 5 has a value larger than 60 deniers, the area of the front edge portion 4 which is stitched by the filament 5 is deformed thereby deteriorating the wig's shape-retainabiity. Moreover, the filament 5 is in contact with the user's forehead which makes the user feel uncomfortable. On the other hand, if the filament is too fine, it cannot have sufficient strength, causing loosening of the front edge portion 4 of the network.

As indicated by the broken lines in FIG. 1, a cut-out 6 is formed near the rear side of the wig base 1 and at an area 6a of the hair whirl. An artificial skin 7 made of a sheet of plastic and corresponding in shape to the cut-out 6 is fixed to the network 2 to cover the cut-out 6. The artificial skin 7 is made preferably of a soft, elastic and stretchable polyurethane or silicone resin, having a thickness of about 0.1–0.6 mm, usually about 0.4 mm. The artificial skin 7 is colored in the same color as the scalp, and may be transparent or semi-transparent with a frosted surface. The artificial skin 7 is provided with a plurality of fine apertures 8 each having a diameter of about 0.5 mm so as to provide excellent ventilation to prevent the scalp area covered by the skin 7, from becoming stuffy. In the illustrated embodiment, the cut-out 6 extends from the hair whirl area 6a and along a hair-parting portion 6b. The cut-out 6 has its front edge 6c which is cut in a zigzag fashion to enhance the camouflaging effect of blurring the border line at the overlapped portion between the artificial skin 7 and the network 2. To this end, the artificial skin 7 also has its front edge which is cut in a zigzag fashion correspondingly to the zigzag configuration of the front edge portion 6c of the cut-out 6. Thus, the border between the artificial skin and the network is visually imperceptible through clearances between the hairs. The artificial skin 7 is welded, bonded or stitched to the peripheral edge of the cut-out 6. It is therefore advantageous that the artificial skin 7 is made slightly larger than the cut-out 6.

The peripheral edge of the network 2 including right, left and rear side edges except for the front edge portion 4 is fringed at 9 by a coating of polyurethane resin or the like to prevent the filaments forming the network 2 from becoming loose and to reinforce the network 2. This fringe 9 is covered by the planted hair fibers and is thus left unexposed.

As indicated by the broken lines in FIG. 1, a plurality of bonding strips (four in the illustrated embodiment) 10a, 10b, 10c and 10d made of coating of polyurethane resin may be arranged on the periphery of the inner surface of the wig base 1. These bonding strips serve stoppers or stays for pressure sensitive adhesive double coated tapes to fix the wig W to the user's head. It is extremely advantageous to use the stoppers disclosed in Japanese Patent Publication No. Sho 54-16785 filed by the same applicant as that of the present application. A polyurethane resin film may be stitched to some appropriate peripheral positions on the inner surface of the wig, in substitution for the bonding strips 10a, 10b, 10c and 10d formed by coating.

A wig manufacturing process of the present invention will be outlined below. Using a male die which is in strict agreement in contour and dimension to the user's head, the network 2 is first made according to the method disclosed in the above-mentioned Japanese Patent Preliminary Publication No. Sho 61-124615. The front edge portion 4 of the network 2 is cut in a zigzag fashion by scissors over the extent between the right and left corners of the hairline of the user's forehead. The network 2 is then machine-sewed about 3–15 mm inside the zigzag front edge portion 4 by a nylon filament. The nylon filament is not line- but zigzag-sewed in phase with or in opposite phase with the zigzag front edge portion 4, so that the camouflaging effect is enhanced to leave the filament-stitching portion 5 imperceptible. The inclined side of each of the zigzags formed at the front edge of the network 2 and the inclined side of each of the zigzags formed by the stitching filament 5 may be about 3–13 mm long.

Each of the filaments 2a and 2b which form the network 2 is coated with the polyurethane resin film 3, as shown in FIG. 3, to make them strong and prevent them from becoming loose. In addition, the filaments 2a and 2b are ultrasonically welded at their intersections 2d by the ultrasonic welder. It is preferable that the stitching nylon filament is also coated with the polyurethane rein film 3 and welded to the network at their intersections to increase the strength of the network.

The network 2 is cut out by scissors at the hair whirl area and also at the hair-parting area extending forwardly from the hair whirl area, to thereby form the cut-out 6, whose front edge is cut in a zigzag fashion. The artificial skin 7 identical in shape with or preferably slightly wider than the cut-out 6 is independently made using the above-mentioned male die and is bonded or stitched to cover the cut-out 6. For instance, the artificial skin 7 is made about 3 mm wider than the cut-out 6 and is then overlaid upon the network 2 to cover the cut-out such that the peripheral edge of about 3 mm of the artificial skin 7 is overlapped with the peripheral edge of the cut-out 6. Then, masking is applied to the network 2 except for the overlapped area. Subsequently, polyurethane or silicone rein is applied to the overlapped area to bond the artificial skin 7 to the network 2. Fringing resin coating is similarly applied to the peripheral edge of the network 2 except for the front edge portion thereof. The fixing bonding strips 10*a*, 10*b*, 10*c* and 10*d* such as stoppers or pressure sensitive adhesive double coated tapes are formed by resin coating at some appropriate peripheral locations on the inner surface of the network 2. In place of the bonding strips, a polyurethane resin film may be stitched to the inner peripheral surface of the network 2.

Finally, human and/or artificial hairs are implanted on the outer surface of the wig base thus manufactured. It is preferable in this case that the hair fibers H are attached up to locations as near the tip of each of the zigzags as possible at the front edge portion 4 of the network 2 to create a natural hairline. Further, as compared with the remaining area of the network 2, a larger number of the hair fibers H are attached to a portion of the artificial skin, which corresponds to the hair whirl area of the network 2, so as to extend spirally clockwise or counterclockwise. After the hair fibers H are thus planted, the artificial skin is punched to form a plurality of fine apertures each having a diameter of about 0.5 mm, thereby completing the wig according to the first embodiment of the invention.

Figure 6:
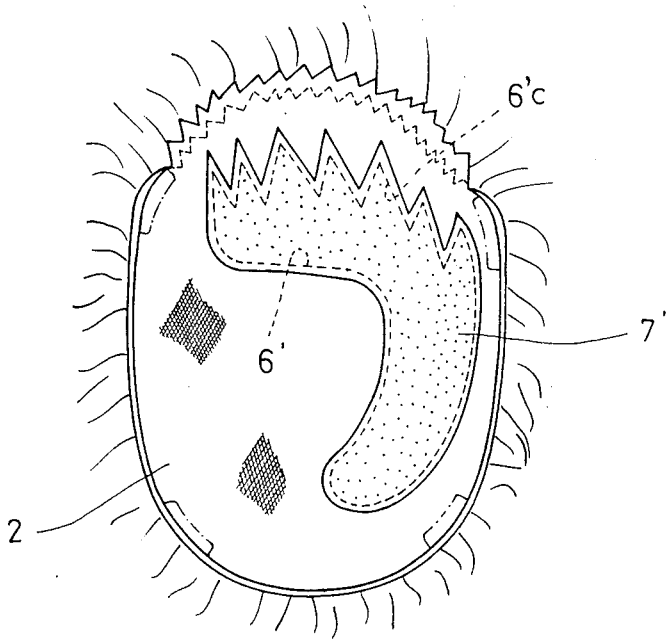
FIG. 6 is a view similar to FIG. 1, but showing a second embodiment of the wig wherein an artificial skin extends to the neighborhood of the user's forehead.

FIG. 6 shows a second embodiment of he present invention, which has a variation of the artificial skin fixed to the cut-out in the network. Generally, a human head is semi-spherical in shape in which curved lines are drawn in all directions, centering around the parietal. A portion of the head which extends from the parietal to the forehead can most visually be noticed by a third person. Accordingly, if the network is formed by an artificial skin colored in the same color as the scalp at that portion of the network where the scalp can easily be noticed through clearances between the hair fibers, the presence of the wig can be made much less noticeable. To this end, an artificial skin 7' is extended from the hair whirl area to an area adjacent the forehead along the hair-parting line. Like the first embodiment illustrated in FIG. 1, a cut-out 6' is cut in a zigzag fashion, at least at the front edge 6'c thereof which faces the user's forehead. The artificial skin 7' corresponding in shape to the cut-out 6' is fixed to the latter. Thus, the border between the network 2 and the artificial skin 7' can be blurred to enhance the camouflaging effect.

In the case of the two embodiments shown in FIGS. 1 and 6, a part of the network is cut out and a piece of artificial skin which is made independently of the network may be attached to that area of the network where the hair whirl and/or hair-parting portion are/is to be formed, without cutting out this area of the network. Alternatively, resin coating may be applied directly onto this area of the network where the hair whirl and/or hair-parting portion are/is to be formed. Same effects as those of the first and second embodiments can be attained in any cases.

Figure 7:
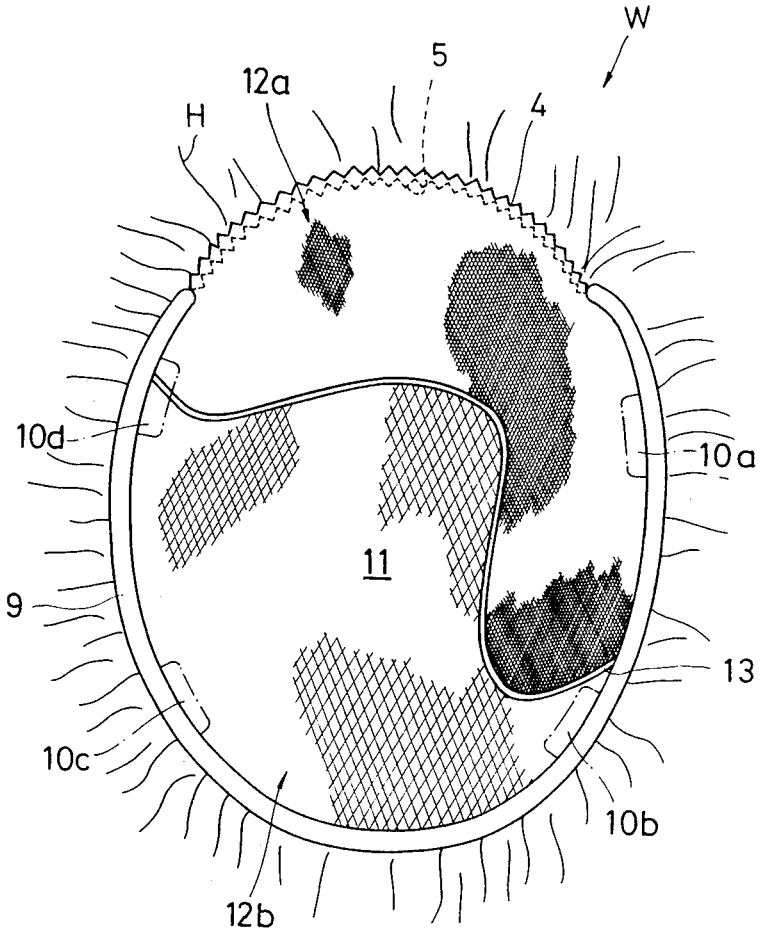
FIG. 7 is a view similar to FIG. 1, but showing a third embodiment of the wig wherein an area of the wig base, which corresponds to the hair-parting and forehead portions of the user's head, is formed by a net having smaller meshes that those of a net forming the remaining area of the wig base.

FIG. 7 shows an inner surface of a wig W according to a third embodiment of the invention. Substantially the entire wig base 11 is formed by a network 12 comprising a first net 12*a* which forms a hair-parting portion and a forehead area, and a second net 12*b* which forms the remaining area of the wig base 11. Filaments which form the first and second nets 12*a* and 12*b* are resin-coated at the circumferential surface thereof and are ultrasonically welded at their intersections, like the first embodiment.

As shown in an enlarged manner in FIG. 7, the first net 12*a* which forms the hair-parting portion and forehead area has a smaller mesh than the mesh of the second net 12*b* which forms the remaining area including the temple area on the side opposite to the hair-parting portion, the parietal area and the occiput area. Generally, the net which forms the wig base ha comparatively rough meshes of about 14–24 meshes per square inch and this roughly-meshed net which is conventionally available can be used as the second net 12*b*. However, the hair-parting portion and the forehead area can most easily be noticed by a third person. Accordingly, if the roughly-meshed net is used to cover the hair-parting portion and the forehead area, hair fibers which are tied to net filaments are limited in number so that the wig base net might be made more noticeable through clearances between the hair fibers. As a result of various studies on this point, it has been found that if the first net 12*a* has about 28–48, preferably about 32–35 meshes per square inch, the above problem can be solved because a sufficient number of hair fibers can be planted on the net.

The first net 12*a* has the front edge portion 4 corresponding in position and dimension to the user's forehead. This front edge portion 4 is cut in a zigzag fashion at its free edge and stitched in a zigzag fashion at a location slightly inside the free edge by a filament 5. The stitching filament 5 extends in a zigzag fashion in phase with or in opposite phase with the zigzag free edge of the front edge portion 4.

Numeral 13 represents a connected portion between the first and second nets 12*a* and 12*b*, wherein the first and second nets 12*a* and 12*b* are placed one upon the other at their confronting edges and are connected to each other by resin coating. They may be stitched or bonded together at their overlapped portions instead of using resin coating, but it is more preferable from the viewpoint of strength and shape-retainability that they are machine-sewed and then connected by resin coating.

It should be understood that the invention is not limited to the above-described embodiments, but that various changes and modifications can be made without departing from the spirit and scope of the present invention. For example, it may be optionally done by those skilled in the art that the wig base shown in FIG. 7 is cut out at its portion on which a hair whirl is formed and that an artificial skin is attached to this cut-out. Further, the present invention can be applied to those wig bases which are formed by a woven or non-woven net, as well as the wig base disclosed in the above-mentioned Japanese Patent Preliminary Publication No. Sho 61-124615 filed by the same applicant as that of the present application. The invention can therefore be applied to the wig base of the U.S. Pat. No. 3,905,378, for example, which is formed by a non-woven nylon net.

We claim:

1. A wig comprising:

a wig base substantially entirely formed of a network having a convexly curved surface in conformity with a user's head contour;

hairs planted over the entire said convexly curved surface of said wig base;

said network having a front edge portion corresponding to a hairline at a user's forehead, said front edge portion being formed in a zigzag fashion; and filament means stitched through said wig base at a location slightly behind said front edge portion, wherein the network which forms the wig base defines a cut-out portion which corresponds to a location for forming a hair whirl, and wherein said wig further includes an artificial skin which closes the cut-out portion of the network, said artificial skin being made of a sheet of flexible plastic and being substantially the same shape as the cut-out portion.

2. A wig according to claim 1 wherein the network which forms the wig base is made of resin-coated filaments and wherein said filaments are plain-woven and ultrasonically welded at their intersections to form substantially rhomboid meshes.

3. A wig according to claim 1 wherein front edge portions of said artificial skin and said cut-out portion are both formed in a zigzag fashion in a manner similar to said front edge portion of the network.

4. A wig according to claim 1 wherein said artificial skin is formed from colored polyurethane resin having the same color as the scalp of the user.

5. A wig according to claim 1 wherein said artificial skin is slightly larger in size than the cut-out portion of the network and defines a circumferential rim thereof, and wherein said artificial skin includes a resin coating at its circumferential rim which overlaps the network when said artificial skin covers the cut-out portion.

6. A wig according to claim 1 wherein the cut-out portion extends from the hair whirl forming location along a hair-parting line.

7. A wig according to claim 1, further comprising a piece of artificial skin made from a sheet of flexible plastic and fixed onto at least that area of the network which corresponds to a location for forming a hair whirl.

8. A wig according to claim 7 wherein the piece of artificial skin extends from the hair whirl forming location along a hair parting portion on the network, and wherein the artificial skin has a front edge portion formed in a zigzag fashion.

9. A wig according to claim 1 wherein the artificial skin is provided with a plurality of fine apertures for ventilation.

10. A wig according to claim 1 wherein the network includes a first net having a hair-parting area and a forehead area, and a second net, said first net having a smaller mesh than said second net.

11. A wig according to claim 10 wherein the first and second nets are connected together at respective confronting edges by any one of resin coating and stitching.

12. A wig according to claim 10 wherein the first net is formed by nylon filaments each having about 100–400 deniers so as to form about 14–24, preferably about 16–20 meshes per inch.

13. A wig according to claim 12 wherein the nylon filaments which form the first and second nets are colored substantially in the same color as a user's scalp.

14. A wig according to claim 13 wherein said filament means is a nylon filament of about 30–60 deniers.

15. A wig according to claim 1 wherein the network is stitched at a location slightly behind its front edge portion by said filament means, and extending in one of a phase identical with said zigzag front edge portion of the network and a phase opposite thereto.

16. A wig according to claim 1 wherein the network which forms the wig base includes a coating of polyurethane resin at its circumferential rim except along its front edge portion.

17. A wig according to claim 1 further comprising at least one bonding strip formed on an inner peripheral surface of said wig base by means of a resin coating.

18. A wig according to claim 1 further comprising at least one bonding strip stitched to the inner peripheral surface of the said wig base.

19. A wig according to claim 18 further comprising at least one stopper and double-sided adhesive tape attached to said bonding strip so as to fix the wig to a user's scalp.

* * * * *